US007457683B2

(12) United States Patent
Bailie

(10) Patent No.: US 7,457,683 B2
(45) Date of Patent: Nov. 25, 2008

(54) ADJUSTABLE EMBROIDERY DESIGN SYSTEM AND METHOD

(76) Inventor: Brian D. Bailie, 27 Cedar Hill Pl. NE., Albuquerque, NM (US) 87122

( * ) Notice: Subject to any disclaimer, the term of this patent is extended or adjusted under 35 U.S.C. 154(b) by 297 days.

(21) Appl. No.: 11/350,262

(22) Filed: Feb. 8, 2006

(65) Prior Publication Data

US 2007/0198119 A1 Aug. 23, 2007

(51) Int. Cl.
*D05C 5/02* (2006.01)

(52) U.S. Cl. ..... 700/138; 700/131; 700/136; 700/137; 112/470.01; 112/470.04; 112/475.19

(58) Field of Classification Search ..... 700/130, 700/131, 132, 133, 136, 137, 138; 112/78, 112/102.5, 470.01, 470.04, 475.18, 475.19; 345/156, 157, 168, 173, 180
See application file for complete search history.

(56) References Cited

U.S. PATENT DOCUMENTS

| | | | | |
|---|---|---|---|---|
| 5,239,475 | A * | 8/1993 | Shigeta et al. | 700/137 |
| 5,270,939 | A | 12/1993 | Goldberg et al. | |
| 5,343,401 | A * | 8/1994 | Goldberg et al. | 700/138 |
| 5,410,976 | A * | 5/1995 | Matsubara | 112/102.5 |
| 5,558,031 | A * | 9/1996 | Muto et al. | 112/102.5 |
| 5,558,033 | A | 9/1996 | Futamura et al. | |
| 5,692,448 | A * | 12/1997 | Shigeta | 112/102.5 |
| 5,791,270 | A * | 8/1998 | Mori | 112/102.5 |
| 5,794,553 | A | 8/1998 | Futamura | |
| 5,867,391 | A * | 2/1999 | Muto | 700/137 |
| 5,894,294 | A * | 4/1999 | Morita | 345/157 |
| 5,934,209 | A | 8/1999 | Mizuno | |
| 5,954,004 | A * | 9/1999 | Futamura | 112/102.5 |
| 6,004,018 | A | 12/1999 | Kawasato et al. | |
| 6,032,596 | A * | 3/2000 | Hayakawa | 112/102.5 |
| 6,510,360 | B1 * | 1/2003 | Kaymer et al. | 700/138 |
| 6,600,966 | B1 | 7/2003 | Bailie | |
| 6,633,794 | B2 | 10/2003 | Bailie | |
| 6,732,008 | B2 | 5/2004 | Bailie | |
| 6,944,605 | B2 | 9/2005 | Bailie | |

FOREIGN PATENT DOCUMENTS

| | | | |
|---|---|---|---|
| GB | 2334264 A | * | 8/1999 |
| GB | 2341529 A | * | 3/2000 |
| JP | 09176956 A | * | 7/1997 |

* cited by examiner

*Primary Examiner*—Gary L. Welch
*Assistant Examiner*—Nathan E Durham
(74) *Attorney, Agent, or Firm*—Small Patent Law Group; Christopher R. Carroll

(57) ABSTRACT

A system and method for an interactive embroidery design specified by vector data and 3-dimensional data modifying shape and parameter data. A processor is configured to execute computer-executable instructions to create an adjustable design as indicated by artist input. The adjusted design is modified by embroidery machine operator input and is converted into stitch instructions for use by an embroidery machine to manufacture a custom embroidered product including the adjusted design.

23 Claims, 15 Drawing Sheets

ARTIST
SYSTEM

EMBROIDERY MACHINE OPERATOR SYSTEM (FIG. 1A ROTATED RIGHT 45°)

(FIG. 1A SCALED DOWN)

(FIG. 1A WITH LEFT SIDE TRANSLATED LEFT)

(FIG. 1A WITH SIDES TRANSLATED OUTWARD)

(FIG. 1A WITH CLOUD ONLY ROTATED RIGHT 45°)

(FIG. 1A WITH CLOUD ONLY SCALED DOWN)

(FIG. 1A WITH LEFT SIDE OF CLOUD ONLY TRANSLATED LEFT)

(FIG. 1A WITH SIDES OF CLOUD ONLY TRANSLATED OUTWARD)

ADJUSTABLE EMBROIDERY DESIGN SYSTEM AND METHOD

BACKGROUND

This generally relates to the field of machine embroidery. In particular, this relate to a system and method for assisting an artist in creating an adjustable embroidery design from an original embroidery design. In addition, this relates to a system and method for assisting an embroidery machine operator in creating an adjusted embroidery design for producing a customized embroidered product including the adjusted embroidery design.

In the field of machine embroidery, specifically the production of an embroidered fabric, there are two primary types of labor: (1) an artist, who creates an embroidery design, which will be embroidered onto the fabric; and (2) an embroidery machine operator, who transfers the design data defining the created embroidery design into the embroidery machine, adjusts parameter data relating to the creation of the embroidered fabric and operates the embroidery machine to create an embroidered fabric. Embroidery designs have originated as static artwork, represented by shape data defining outlines and parameter data defining stitches and colors within the outlines. The various input mechanisms to enter design data into a computer have been well understood by artists familiar with embroidery.

An artist is a highly skilled professional, whereas the operator may be relatively unskilled. Currently, the artist needs to craft a specific embroidery design for each and every unique view of that design's subject matter. For instance, if the embroidery machine operator needs a rose leaning to the left, and also a rose leaning forward, the artist needs to spend considerable time in crafting two separate embroidery designs. This redundancy of labor is not efficient.

There is a need to overcome this inefficiency by allowing the artist to create an embroidery design having a variable shape which may be varied by an operator or other person, thereby allowing the possibility of rotation and other n-dimensional effects to the embroidery design. Thus, an adjustable embroidery design could be created by an artist and varied by an embroidery machine operator to create an adjusted embroidery design having stitches that represent an embroidery design presented in a number of different viewpoints and in various sizes and positions.

In summary, there is a need for a system and method which allows an artist to create an adjustable embroidery design. There is also a need for an adjustable embroidery design which can be modified by a relatively unskilled operator. There is also a need to have parameter data which is self-modified in response to modifications to the shape data.

SUMMARY

In one embodiment, the invention comprises a system and method used by an artist to create a 2-dimensional or 3-dimensional adjustable embroidery design which may be modified by an embroidery machine operator to create a 2-dimensional adjusted embroidery design which may be exported as stitch instructions to an embroidery machine.

In one embodiment, the invention comprises a system and method in which an artist creates a 2-D or 3-D adjustable embroidery design having shapes, having parameters within each shape and having permissible variations defined by vector data which modify the shapes and/or the parameters.

In one embodiment, the invention comprises a system and method in which an embroidery machine operator modifies a 2-D or 3-D adjustable embroidery design to create a 2-D adjusted embroidery design exportable to an embroidery machine as stitch instructions.

Other features will be in part apparent and in part pointed out hereinafter.

This summary is provided to introduce a selection of concepts in a simplified form that are further described below in the detailed description. This summary is not intended to identify key features or essential features of the claimed subject matter, nor is it intended to be used as an aid in determining the scope of the claimed subject matter.

BRIEF DESCRIPTION OF THE DRAWINGS

FIG. 8 illustrates an original 4-sided rectangular shape which is modified to an 8-sided shape. FIG. 9 illustrates part of the modified shape of FIG. 8 overlaid on a circular shape. FIG. 10 illustrates the result of the overlay of FIG. 9 and the resultant clipping of the circular shape. FIG. 11 illustrates how stitch lengths, which customarily would be equal on all stitches in a given region, are modified based on the curvature of the circular shape. FIG. 12 shows the apparent length of stitches from an x-axis and a z-axis curve when projected onto an x-axis and a y-axis plane, showing how the stitch lengths need to be adjusted for improved creation of the final stitch data.

Corresponding reference characters indicate corresponding parts throughout the drawings.

DETAILED DESCRIPTION

Figure 1A:
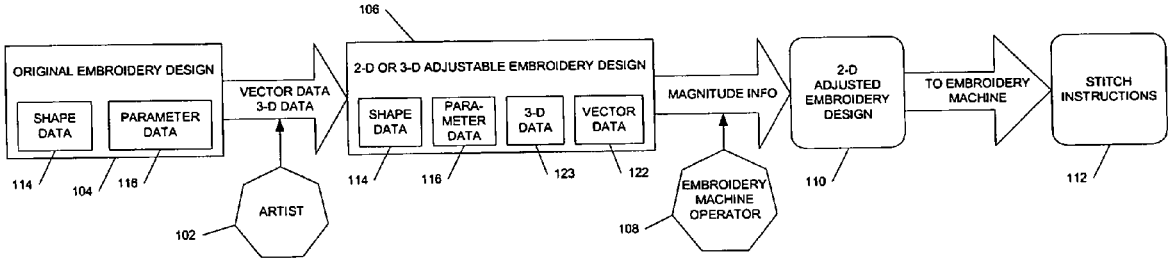
FIG. 1A is a flow diagram illustrating the instructions executed by one or more processors for converting an original embroidery design to a 3-dimensional adjustable embroidery design which is converted into a 2-dimensional adjusted embroidery design which is exported as stitch instructions.

Initially referring to FIG. 1A, an artist 102 creates or obtains from a library a 2-dimensional original embroidery design 104. The invention permits the artist 102 to create a 2-dimensional or 3-dimensional adjustable embroidery design 106 by adding vector data and/or 3-dimensional data to the 2-dimensional original embroidery design 104. Alternatively, the artist 102 can create a 2-dimensional or 3-dimensional original embroidery design.

Next, an embroidery machine operator (EMO) 108 adds magnitude information to modify the adjustable embroidery design 106 by selecting from a plurality of n-dimensional translating, rotating, scaling and/or other manipulations. As a result, a 2-dimensional adjusted embroidery design 110 as modified by input from the embroidery machine operator 108 is computed from the 2-dimensional or 3-dimensional adjustable embroidery design 106. From the 2-dimensional adjusted embroidery design 110, stitch data 112 is exported to an embroidery machine to create a customized embroidered product.

A customized embroidered product means that the embroidery machine operator 108 has made changes to the adjustable design 106 to create an adjusted design 110 which is embroidered on the product by an embroidery machine. For example, the EMO 108 may rotate or scale the adjustable design 106. The modifications added by the artist 102 and adjusted by the EMO 108 may reside in n-dimensions, allowing changes such as three-dimensional rotation, wherein a three dimensional object can be rendered into embroidery stitch instructions 112 based on any view or perspective, as directed by the EMO 108. This interactivity between the embroidery machine operator 108 and the adjustable embroidery design 106 allows customized embroidered products and increases productivity, as a single design can be used for multiple purposes.

Figure 1B:
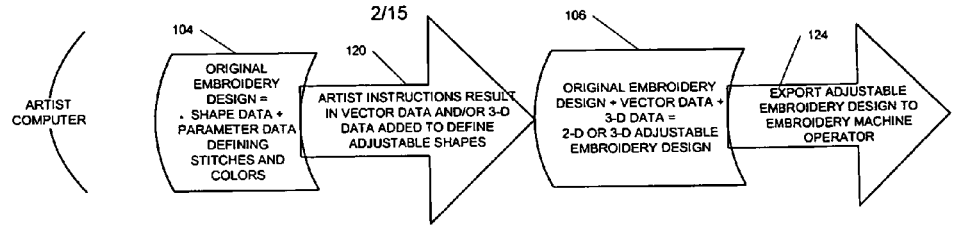
FIG. 1B is a flow diagram illustrating the instructions executed by a processor of an artist's computer in which an original embroidery design is modified to yield a 3-dimensional adjustable embroidery design.

FIG. 1B is a flow diagram illustrating the instructions executed by a processor of an artist's computer system 150 (see FIG. 1E) in which an 2-dimensional or 3-dimensional original embroidery design is modified by the artist 102 to yield a 2-dimensional or 3-dimensional adjustable embroidery design 106. As shown in FIG. 1B, vector data 122 and/or 3-dimensional data 123 is added at 120 to the shape data and parameter data of the original embroidery design 104 by the artist 102. The vector data 122 defines adjustable shapes of the original embroidery design 104. The 3-dimensional data 123 adds a third dimension to a 2-dimensional original embroidery design. The resulting 2-dimensional or 3-dimensional adjustable embroidery design 106 is exported at 124 to an embroidery machine operator for use on a computer to drive an embroidery machine.

The artist's computer constitutes a system 150 for use by the artist 102 and for use with an 2-dimensional or 3-dimensional original embroidery design 104 having shape data 114 defining shapes and parameter data 116 defining stitches and colors within each shape. The system assists the artist 102 in creating an adjustable embroidery design 106 from the original embroidery design 102. A processor 152 of the system executes software instructions for accomplishing this. The processor receives instructions 120 from the artist 102 and executes computer executable instructions 154 for defining vector data 122 which is added to the shape data 114 to define adjustable shapes of the shape data and to create the 2-D or 3-D adjustable embroidery design 106 which corresponds to the original embroidery design 104. The adjustable embroidery design 106 in a form that is readable for export at 124 to a computer of the embroidery machine operator 108 for creating the adjusted embroidery design 110.

Figure 1C:
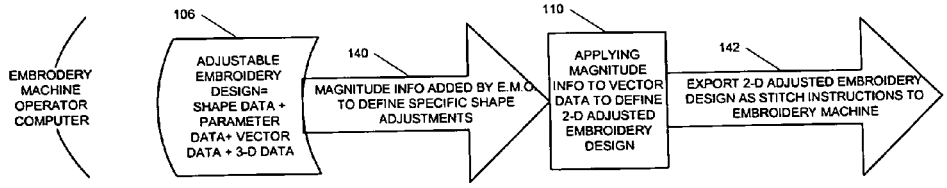
FIG. 1C is a flow diagram illustrating the instructions executed by a processor of an embroidery machine operator's computer in which a 3-dimensional adjustable embroidery design is modified into a 2-dimensional adjusted embroidery design exported as stitch instructions.
Figure 1D:
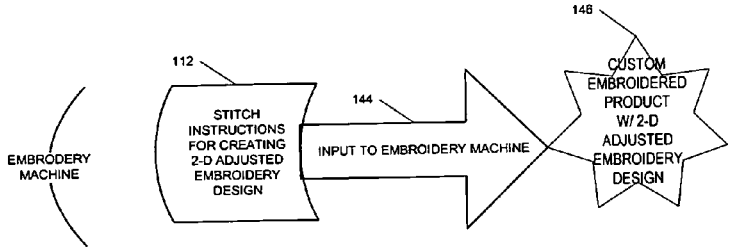
FIG. 1D is a flow diagram illustrating the instructions executed by a processor of an embroidery machine to produce a custom embroidered product including the 2-dimensional adjusted embroidery design.
Figure 1E:
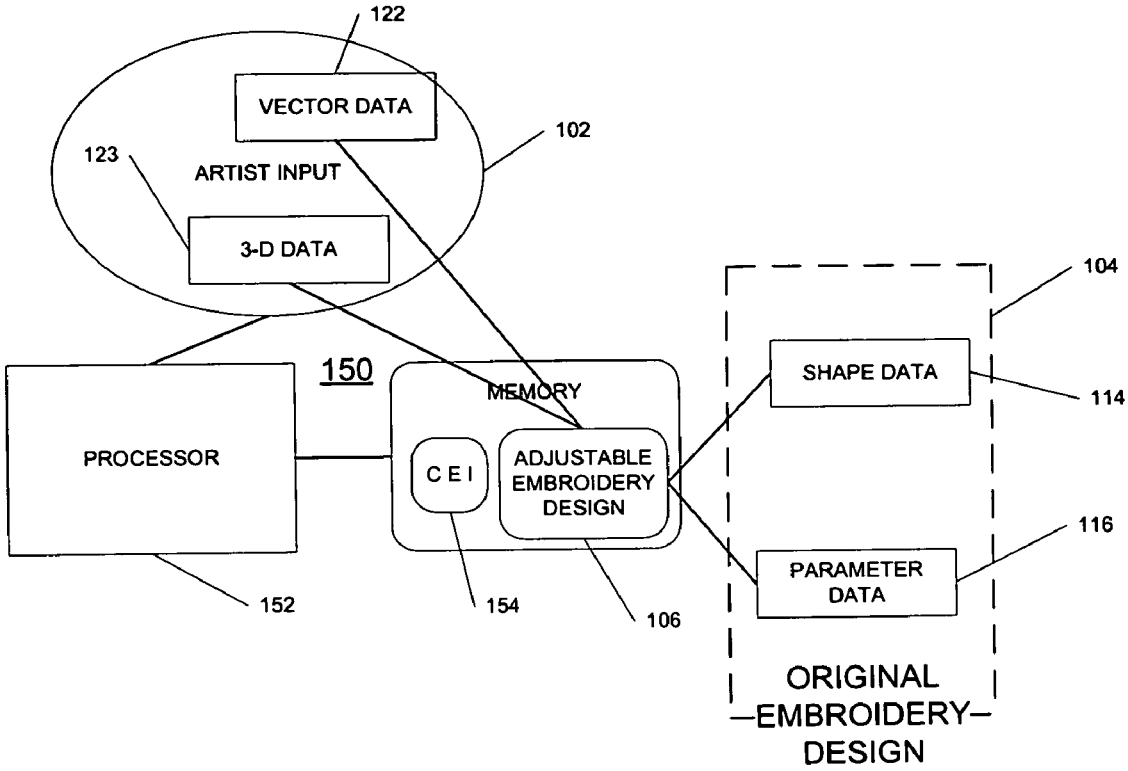
FIG. 1E is a block diagram of one embodiment of a system of the invention as used by an artist.
Figure 1F:
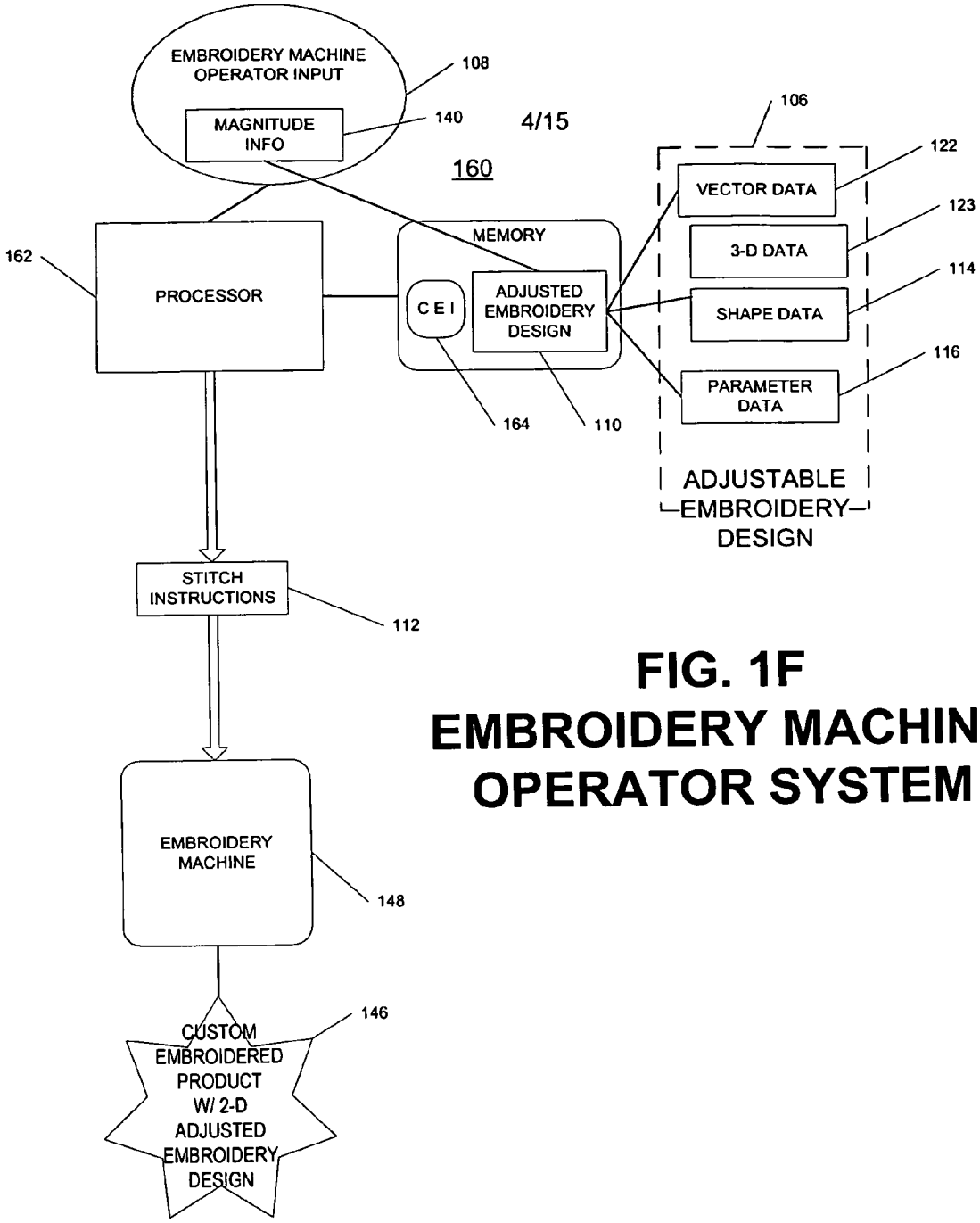
FIG. 1F is a block diagram of one embodiment of a system of the invention as used by an embroidery machine operator.

One embodiment of a system of the invention as illustrated in FIG. 1E includes system 150. FIG. 1E illustrates a system that would be used by the artist 102 and FIG. 1F illustrates a system 160 that would be used by the embroidery machine operator 108. In the artist system 150, the artist input 102 defines the vector data 122 and the 3-D data 123 to be added to the shape data 114 and the parameter data 116 of the original embroidery design 104 to create the adjustable design 106. In other words, the artist 102 defines permissible changes in the shapes, such as translating, rotating and/or scaling the shape data 114. In addition, the artist defines permissible changes in the parameters of each shape. Such changes are stored as the vector data 122 and 3-D data 123. A processor 152 is configured to execute computer-executable instructions (CEI) 154 to interact the shape data 114 and its corresponding parameter data 116 with the vector data 122 and 3-D data 123 according to permissible changes in the shapes and parameters.

FIG. 1C is a flow diagram illustrating the instructions executed by a processor 162 of an embroidery machine operator's computer system 160 (see FIG. 1F) in which a 3-dimensional adjustable embroidery design is modified into a 2-dimensional adjusted embroidery design exported as stitch instructions. As shown in FIG. 1C, the 2-dimensional or 3-dimensional adjustable embroidery design 106 is modified in response to input (i.e., magnitude information) at 140 from the EMO 108 to create the 2-dimensional adjusted design 110. The adjusted embroidery design 110 is exportable at 142 as stitch instructions 112 readable by an embroidery machine at 144 (see FIG. 1D) for producing an embroidered product 146 with the 2-dimensional adjusted embroidery design 110.

Thus, the EMO's computer comprises a system for use by an embroidery machine operator 108 and for use with a 2-dimensional or 3-dimensional adjustable embroidery design 106 having shape data 114 defining shapes and parameter data 116 defining stitches and colors within each shape and having vector data 122 defining adjustable shapes of the shape data. The system creates a 2-dimensional adjusted embroidery design 110 from the adjustable embroidery design 106. The processor 162 executes instructions 164 for receiving magnitude information 140 (from the embroidery machine operator) for defining a magnitude of the vector data 122 for defining specific adjustments to the shape data 114. The defined magnitude information is applied to the vector data 122 of the adjustable embroidery design 106 to adjust the shapes and/or parameters of the adjustable embroidery design 106 to create new shapes thereby defining the adjusted embroidery design 110. The adjusted embroidery design 110 is exported at 142 as stitch instructions 112 in a form that is readable by an embroidery machine for producing a customized embroidered product 162 corresponding to the adjusted embroidery design 110.

FIG. 1D is a flow diagram illustrating the instructions executed by an embroidery machine 148 to produce a custom embroidered product including the 2-dimensional adjusted embroidery design. In many configurations, the EMO's computer (see FIG. 1F) is connected to the embroidery machine 148. After the EMO has defined the specific shape adjustments, the exported stitch instructions 112 for creating a 2-D adjusted embroidery design are loaded from the EMO's computer to the embroidery machine at 160 resulting in the machine producing a customized embroidered product 162 with the 2-D adjusted embroidery design.

In the EMO system 160, the EMO input 108 defines the magnitude information 140 to be applied to the vector data 122 and the 3-D data 123 which results in revisions to the shape data 114 and the parameter data 116. Thus, the adjustable embroidery design 106 is modified to create the adjusted design 110. In other words, the EMO 108 defines changes in the shapes, such as translating, rotating and/or scaling the shape data 114. In addition, a processor 162 is configured to execute computer executed instructions 164 to define changes in the parameters of each shape. Such changes are stored as the adjusted embroidery design 110. The processor 162 exports the adjusted embroidery design 110 as the stitch instructions 112 to the embroidery machine 148 which manufactures the custom embroidered product 146 with the 2-D adjusted embroidery design.

Figure 2A:
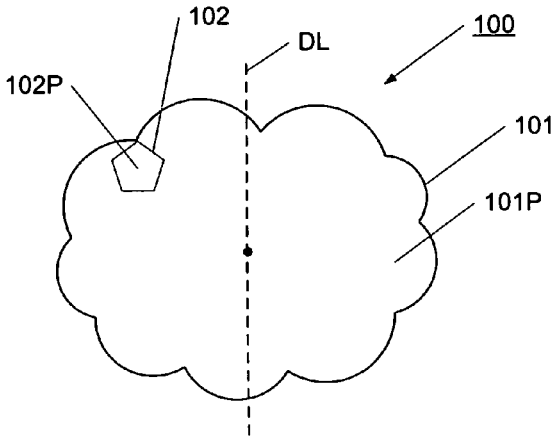
FIG. 2A is an illustration of an embroidery design.

Referring to FIG. 2A, an embroidery design 200 having a variable shape according to one embodiment of the invention is illustrated. The embroidery design 200 is defined by shape data 114 which defines an outline of the shape. The design 200 also includes parameter data 116 which defines various information including stitches and color within each shape. In general, an original embroidery design 104 is defined by a plurality of shapes with each shape having parameter data corresponding thereto for defining stitching within each shape. For simplicity, embroidery design 200 is illustrated as having two shapes, a cloud 201 and a pentagon 202 overlaid within the cloud. A dashed line DL has been added to FIG. 2A to illustrate its orientation. Thus, the parameter data defines cloud parameters 201P within the cloud 201 and defines pentagon parameters 202P within the pentagon 202.

In one optional embodiment, the vector data defined by the artist includes translation data. Thus, the adjustment of the embroidery design by the embroidery machine operator results in modified shape and parameter data containing a plurality of translated data. The translated data defines a plurality of 2-dimensional or 3-dimensional offsets and their corresponding rates of change as described by a two-dimensional curve. The curve describes an amount of displacement as adjusted by input from the embroidery machine operator.

In one optional embodiment, the vector data defined by the artist includes rotational data. Thus, the adjustment of the shape by the embroidery machine operator results in modified shape and parameter data containing a plurality of rotated data. The rotated data defines a plurality of n-dimensional offsets and their corresponding rates of change as described by a two-dimensional curve. The curve describes an amount of rotation as adjusted by input from the embroidery machine operator.

In one optional embodiment, the vector data defined by the artist includes scalar data. Thus, the adjustment of the shape by the embroidery machine operator results in modified shape and parameter data contains a plurality of scaled data. The scaled data defines a plurality of n-dimensional offsets and their corresponding rates of change as described by a two-dimensional curve. The curve describes an amount of scaling as adjusted by input from the embroidery machine operator.

In one optional embodiment, the parameter data contains a plurality of information regarding stitch types and directions.

An embroidery machine operator of a personal computer, which is running a computer program according to one embodiment of the invention, may adjust the shapes 201 and 202 of the embroidery design 200 by translating, rotating and/or scaling each shape independently of the other. According to one embodiment of the invention, vector data which defines permissible modifications to the shapes and parameters is adjusted by the embroidery machine operator to create a modified design. As a result, the design data includes shape data, parameter data and vector data defining a modification to the shape and parameter data wherein the modification is translation, rotation and/or scaling of the shapes and/or parameters of the embroidery design.

Figure 2B:
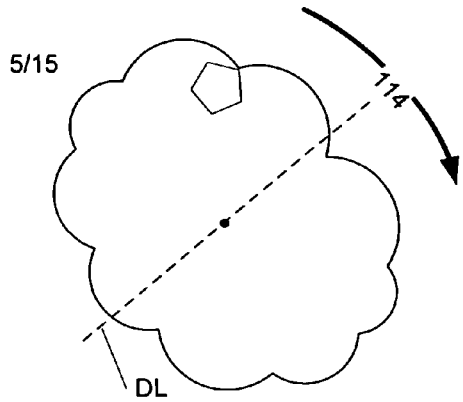
FIG. 2B is the illustration of the embroidery design of FIG. 2A rotated 45° to the right.

For example, a embroidery machine operator may desire to rotate FIG. 2A 45° to the right as illustrated in FIG. 2B. This would mean that the vector data (previously defined by an artist) would define a rotation vector 114 as illustrated in FIG. 2B which would be applied to the shape data defining the cloud 201 and which would be applied to the shape data defining the pentagon 202. To rotate the shapes, the embroidery operator would modify a coefficient or other aspect of this previously defined vector data.

Figure 2C:
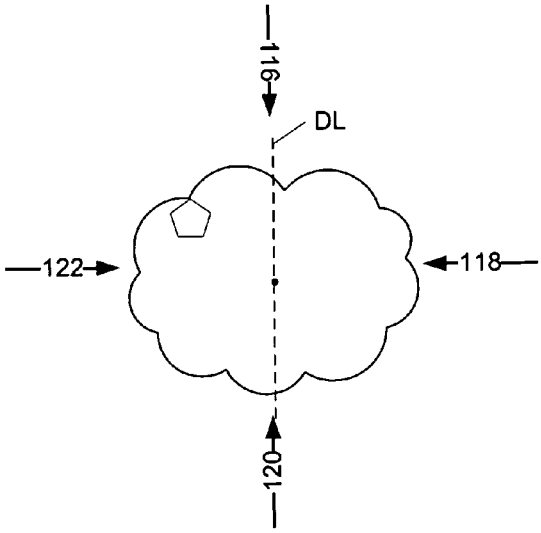
FIG. 2C is the illustration of the embroidery design of FIG. 2A scaled down to a smaller size.

As another example, an embroidery machine operator may desire to scale down FIG. 2A as illustrated in FIG. 2C. This would mean that the previously defined vector data would define scaling vectors 116, 118, 120 and 122 as illustrated in FIG. 2C which would be applied to the shape data defining the cloud 201 and which would be applied to the shape data defining the pentagon 202. To scale the shapes, the embroidery operator would modify a coefficient or other aspect of this previously defined vector data.

Figure 2D:
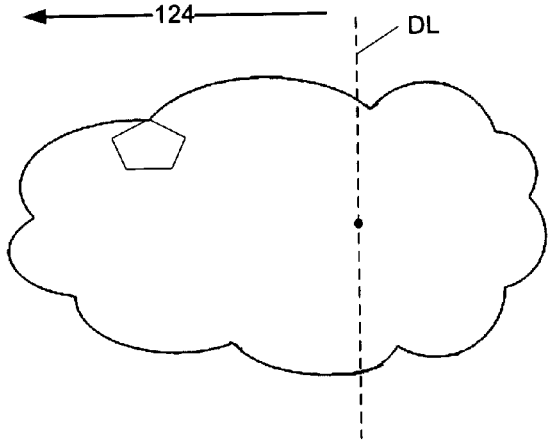
FIG. 2D is the illustration of the embroidery design of FIG. 2A with the left side scaled (reduced or stretched) proportionally to the left.

As another example, a embroidery machine operator may desire to translate the left side of FIG. 2A as illustrated in FIG. 2D. This would mean that the previously defined vector data would define translation vector 124 as illustrated in FIG. 2D which would be applied to the shape data defining the left side of cloud 201 and which would be applied to the shape data defining the pentagon 202. To translate the shapes, the embroidery operator would modify a coefficient or other aspect of this previously defined vector data.

Figure 2E:
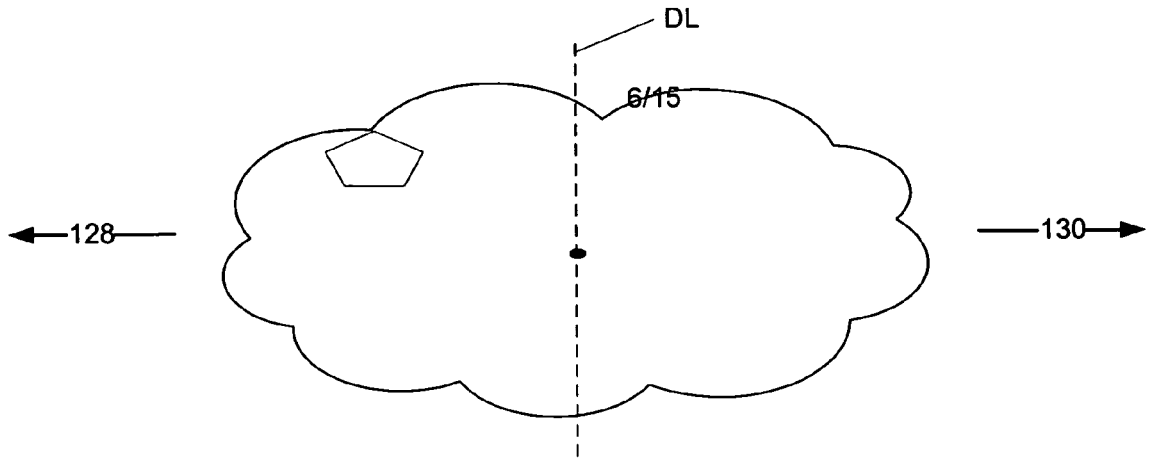
FIG. 2E is the illustration of the embroidery design of FIG. 2A with the left and right sides scaled (reduced or stretched) proportionally outward.

As another example, a embroidery machine operator may desire to translate the both sides of FIG. 2A as illustrated in FIG. 2E. This would mean that the previously defined vector data would define translation vectors 128 and 130 as illustrated in FIG. 2E which would be applied to the shape data defining the sides of cloud 201 and which would be applied to the shape data defining the pentagon 202. To translate the shapes, the embroidery operator would modify a coefficient or other aspect of this previously defined vector data.

Figure 2F:
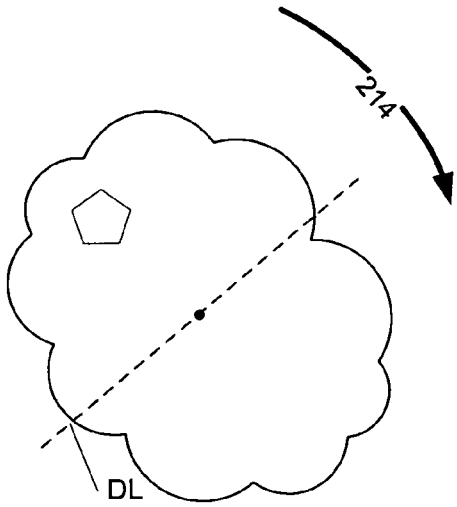
FIG. 2F is the illustration of the embroidery design of FIG. 2A with the cloud only rotated 45° to the right.

As another example, a embroidery machine operator may desire to rotate the cloud 201 of FIG. 2A 45° to the right without rotating the pentagon 202 as illustrated in FIG. 2F. This would mean that the previously defined vector data would define a rotation vector 214 as illustrated in FIG. 2F which would be applied to the shape data defining the cloud 201. To rotate the shapes, the embroidery operator would modify a coefficient or other aspect of this previously defined vector data.

Figure 2G:
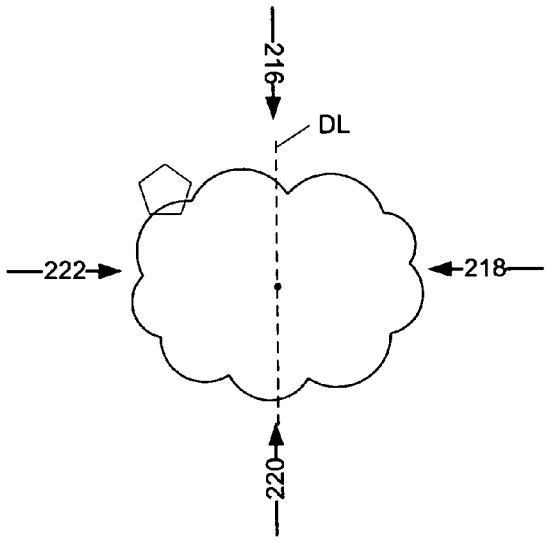
FIG. 2G is the illustration of the embroidery design of FIG. 2A with the cloud only scaled down to a smaller size.

As another example, a embroidery machine operator may desire to scale down the cloud 201 of FIG. 2A without scaling the pentagon 202 as illustrated in FIG. 2G. This would mean that the previously defined vector data would define scaling vectors 216, 218, 220 and 222 as illustrated in FIG. 2G which would be applied to the shape data defining the cloud 201. To scale the shapes, the embroidery operator would modify a coefficient or other aspect of this previously defined vector data.

Figure 2H:
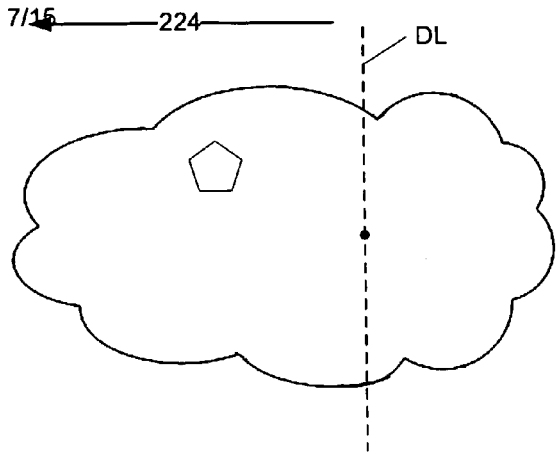
FIG. 2H is the illustration of the embroidery design of FIG. 2A with the left side of the cloud only scaled (reduced or stretched) proportionally to the left.

As another example, a embroidery machine operator may desire to translate the left side of the cloud 201 of FIG. 2A without translating the pentagon 202 as illustrated in FIG. 2H. This would mean that the previously defined vector data would define translation vector 224 as illustrated in FIG. 2H which would be applied to the shape data defining the left side of cloud 201. To translate the shapes, the embroidery operator would modify a coefficient or other aspect of this previously defined vector data.

Figure 2I:
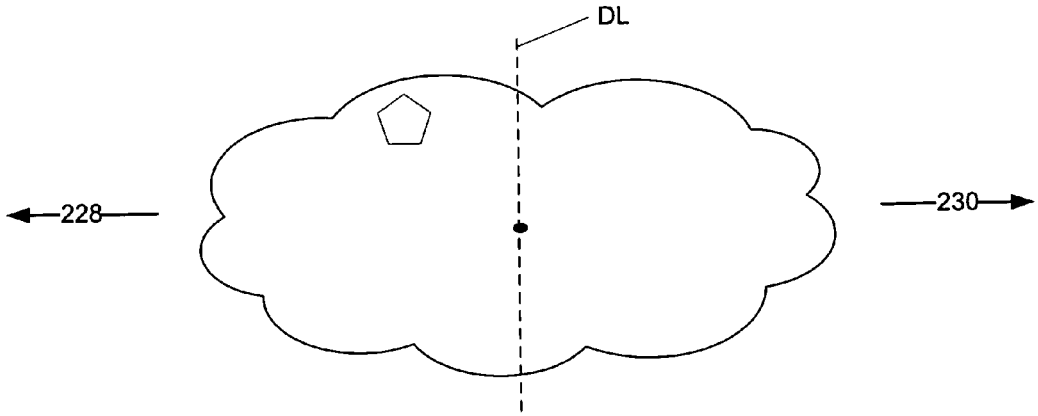
FIG. 2I is the illustration of the embroidery design of FIG. 2A with the left and right sides of the cloud only scaled (reduced or stretched) proportionally outward.

As another example, a embroidery machine operator may desire to translate the both sides of the cloud 201 of FIG. 2A without translating the pentagon 202 as illustrated in FIG. 2I. This would mean that the previously defined vector data would define translation vectors 228 and 230 as illustrated in FIG. 2I which would be applied to the shape data defining the sides of cloud 201. To translate the shapes, the embroidery operator would modify a coefficient or other aspect of this previously defined vector data.

The artist may work in 2 or 3 dimensions, defining permissible outline adjustments to the shape data 172 and corresponding adjustments to the parameter data 174. As the artist defines permissible adjustments to the shapes of the design 152, the adjustments are stored as vector data 170 which is applied to the shape data 172. In addition, permissible modifications to the corresponding parameter data 174 of each shape consistent with the permissible adjustments to the shape are stored as part of the vector data 170. As the artist defines adjustments the shapes in the design, the artist defines vector data regarding the variability of shape, translation, rotation or scale.

It is contemplated that the same adjustment process could be used with any other n-dimensional distortion where n=2 or 3 or more. For example, a 3-dimensional design may be created by the artist and a fourth dimension that could be added to the 3-D design is modification of the design data over the passage of time. As a specific example, a flower could open or close or bend with time. This would allow the operator to observe various positions of the flower to determine which position would make a preferred embroidered product. Those skilled in the art will recognize other dimensional distortions which could be implemented, such as changes in color, position, orientation, etc. Therefore, the initial shape and stitch parameters developed by the artist will have added data for the 3rd and 4th dimensions. This allows modeling a 3D flower as in the example, where parts of the shape go front-to-back.

Once the artist completes the creation the embroidery design, the design is available to the embroidery machine operator of the computerized embroidery machine 266. Such machines are typically controlled and operated by the processor 258 of a personal computer. The embroidery machine operator adjusts the inputs to the design, as they desire, altering the shape of the design. For example, as explained above, the design may be rotated (see FIGS. 2B and 2F), scaled (see FIGS. 2C and 2G), and/or translated (see FIGS. 2D, 2E, 2H and 2I). In one embodiment, the embroidery machine operator is essentially modifying coefficients of the vector data and then the vector data is applied to the shape data and/or the parameter data to generate an adjusted embroidery design.

A vector as defined by the vector data is a mathematical structure which represents direction and magnitude. A vector data set of dimension n is an ordered collection of n elements, which are called components.

An example of a translation vector (x, y, z) is: (2, −5, 0). Hence, the object or part thereof would be moved relatively 2 right, 5 down, 0 back (e.g., an illustration of a triangle, where each side is a vector).

Scale can also be represented as a vector in x, y, z: (2.0, 2.0, 1.0). Hence, the object would be scaled 2×height, 2×width, depth is constant.

Rotation can also be represented as a vector in angle and direction: (45, ccw). Hence, the object would be rotated about its origin counter clockwise by 45 degrees.

Thus, vector data contains a plurality of vectors, each of which can be used for different purposes.

EXAMPLE

Consider a basic set of vectors: V1 (translation), V2 (scale), V3 (rotation).

Now there is a set (called Set) of a number of these basic sets.

Based on user input and calculations done to that input, a selection from the Set will be made, and those vectors applied to the object in question.

Next, consider that based on input a number of vectors from the Set can be utilized. These may be needed to simulate time, complex motion, or some other predefined change of the design. As illustrated in the figures, it is contemplated that the embroidery design may have a variable shape that is composed of a plurality of embroidery data objects. In one embodiment, the shape data contains a set of 2-dimensional or 3-dimensional points describing the shape outline. Each of the points is comprised of floating-point numerical data containing n-dimensional locations in space.

In an optional embodiment, it is also contemplated that underlying aspects of a multi-layer design may be removed. For example, before or after adjustment by an embroidery machine operator, the plurality of defining shapes of an embroidery design may be adjusted by determining the visible component of each of the plurality of shapes, then removing portions of the shapes that are not visible such that the embroidered fabric created as a result of the design will not be overly dense and will be essentially a single layer.

Alternatively or in addition, the parameter data may be modified based on adjustments to shape. For example, parameter data containing stitch lengths may be modified based on adjustments to shape. As a specific example, if the parameter data defines length and the shape data is scaled to 50%, then the length data could also be scaled to 50%. As another example, the parameter data containing stitch direction may be modified based on adjustments to shape. As a specific example, if the parameter data defines orientation and the shape data is rotated by 45, then the length data could also be rotated by 45.

Figure 3:
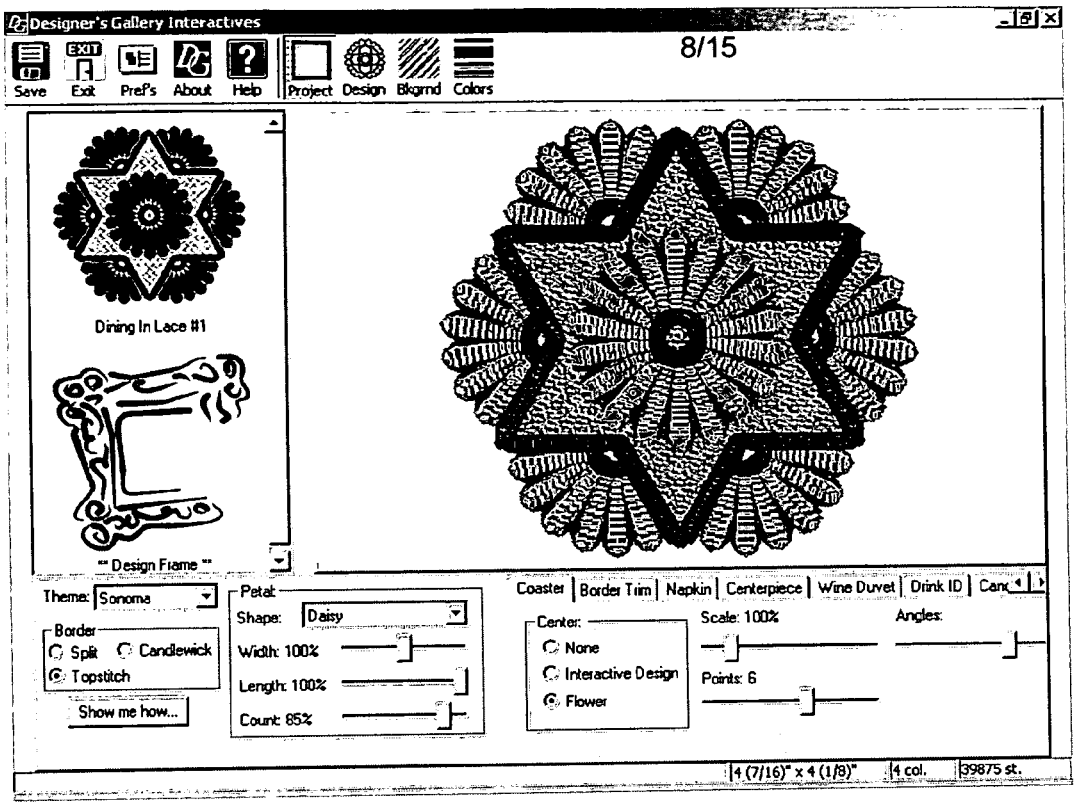
FIG. 3 is a screen shot of one embodiment of the invention illustrating a Coaster.

FIG. 3 is a screen shot of one embodiment of the invention illustrating a coaster. In this dynamic embroidery design of a coaster selected in a daisy shape, the artist has incorporated three borders which can be selected by the EMO: split, candlewick and topstitch. The width, length and count of the daisy can also be selected by the EMO. In addition, the type of center can be selected: none, interactive design, flower. In addition, the scale, number of points and angles can be selected by the EMO. In summary, the artist has added vector data which allows the EMO to vary the daisy coaster before exporting the stitch instructions corresponding to the daisy coaster.

Figure 4:
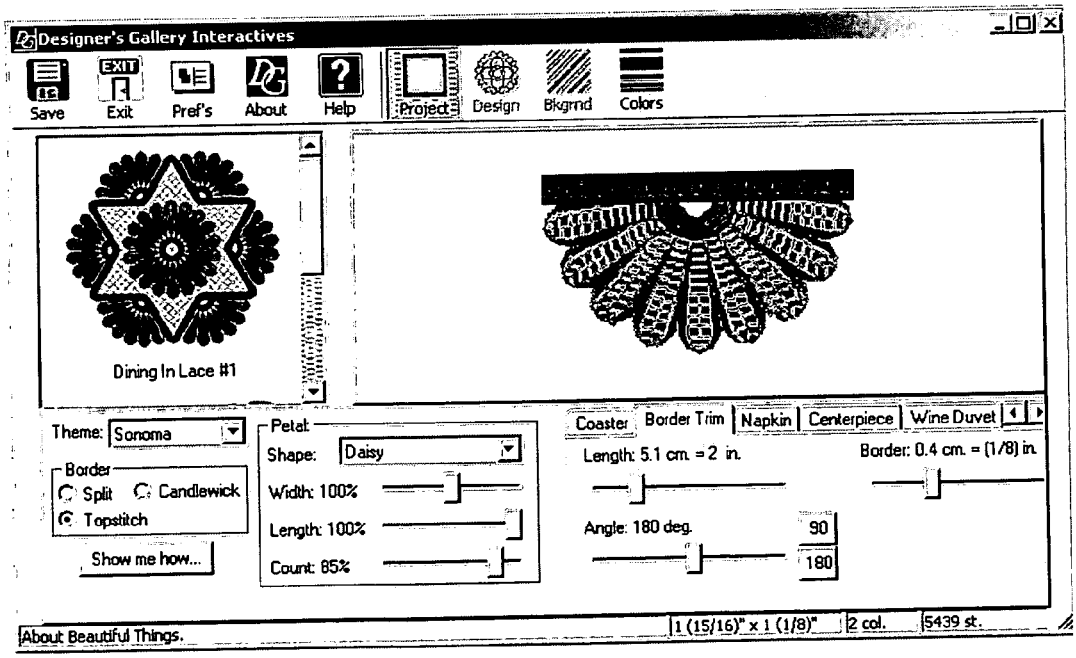
FIG. 4 is a screen shot of one embodiment of the invention illustrating a Border Trim.

FIG. 4 is a screen shot of one embodiment of the invention illustrating a Border Trim. In this dynamic embroidery design of a border trim selected in a daisy shape, the artist has incorporated three borders which can be selected by the EMO: split, candlewick and topstitch. The width, length and count of the daisy can also be selected by the EMO. In addition, the length, border size and angle (90 or 180) can be selected by the EMO. In summary, the artist has added vector data which allows the EMO to vary the daisy border trim before exporting the stitch instructions corresponding to the border trim.

Figure 5:
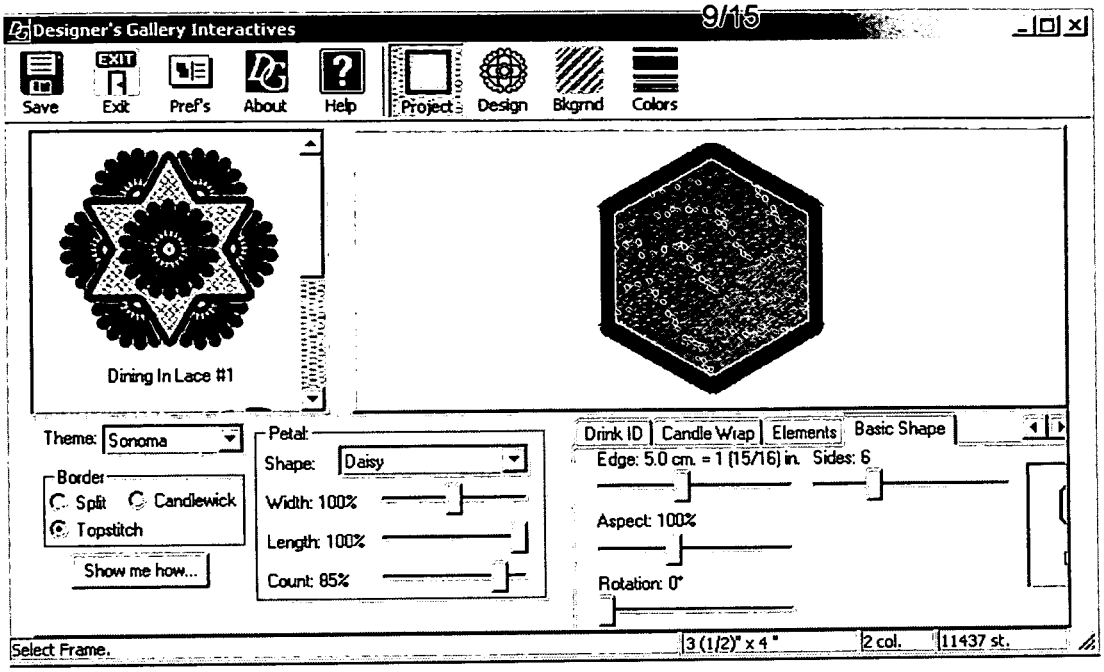
FIG. 5 is a screen shot of one embodiment of the invention illustrating a Basic Shape.

FIG. 5 is a screen shot of one embodiment of the invention illustrating a basic shape. In this dynamic embroidery design of a basic shape selected in a daisy shape, the artist has incorporated three borders which can be selected by the EMO: split, candlewick and topstitch. The width, length and count of the daisy can also be selected by the EMO. In addition, the edge size, aspect, rotation and number of sides can be selected by the EMO. In summary, the artist has added vector data which allows the EMO to vary the daisy basic shape before exporting the stitch instructions corresponding to the basic shape.

Figure 6:
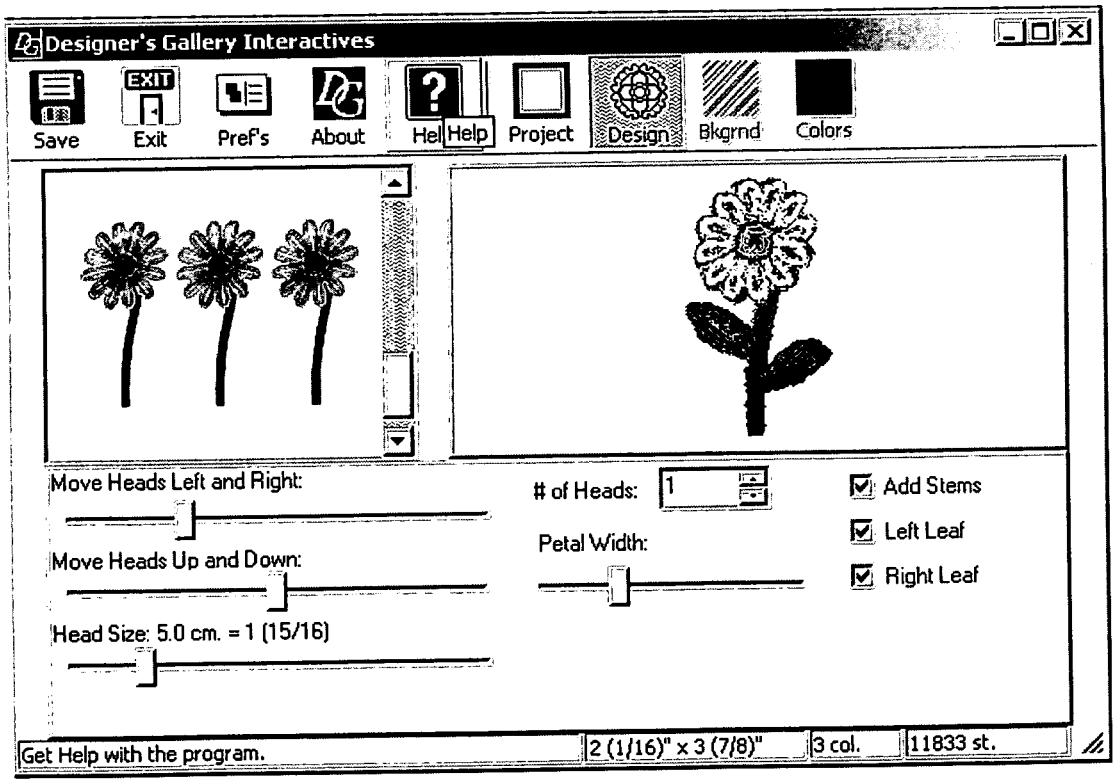
FIG. 6 is a screen shot of one embodiment of the invention illustrating a daisy.

FIG. 6 is a screen shot of one embodiment of the invention illustrating a daisy. In this dynamic embroidery design of a daisy shape, the artist has incorporated the following movements: move heads left to right, move heads up and down. In addition, the head size can be selected by the EMO. In addition, the petal width and number of heads can also be selected by the EMO. In addition, stems, a left leaf and/or a right leaf can be selectively added by the EMO. In summary, the artist has added vector data which allows the EMO to vary the daisy before exporting the stitch instructions corresponding to the daisy.

Figure 7:
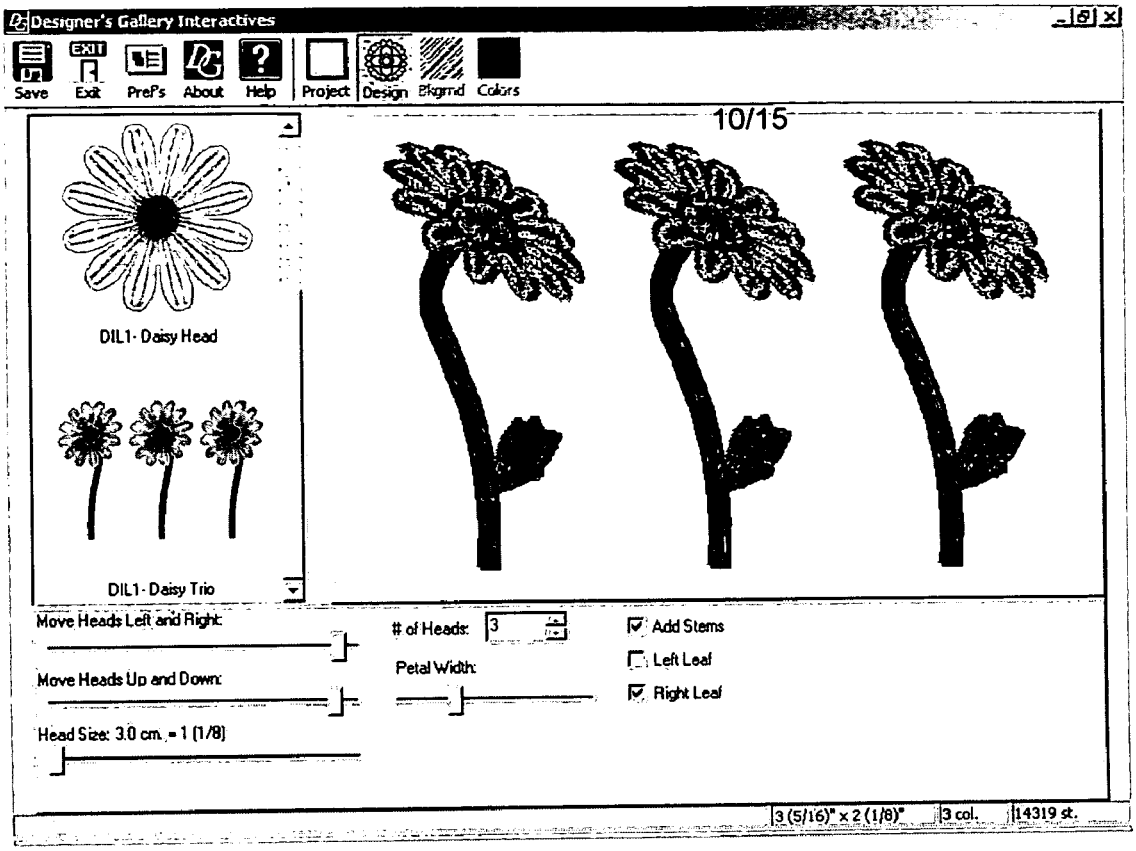
FIG. 7 is a screen shot of one embodiment of the invention illustrating three daisies with heads moved to the right, with heads moved up and with head size of 3.0 cm.

FIG. 7 is a screen shot of one embodiment of the invention illustrating three daisies with heads moved to the right, with heads moved up and with head size of 3.0 cm. FIG. 7 is a variation of FIG. 6 in which the heads have been moved to the right, the heads have been moved up, the head size has increased, the number of heads has been selected as 3, and a right leaf and stems have been selected.

Figure 8:
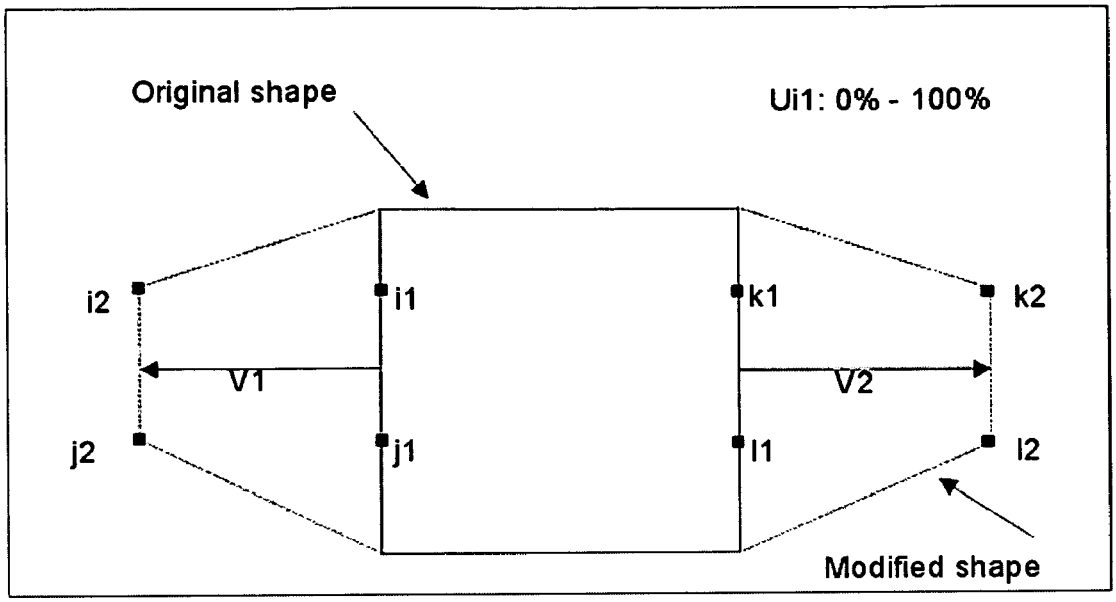
FIGS. 8-12 illustrate line drawings of a shape in various stages according to the invention.
Figure 9:
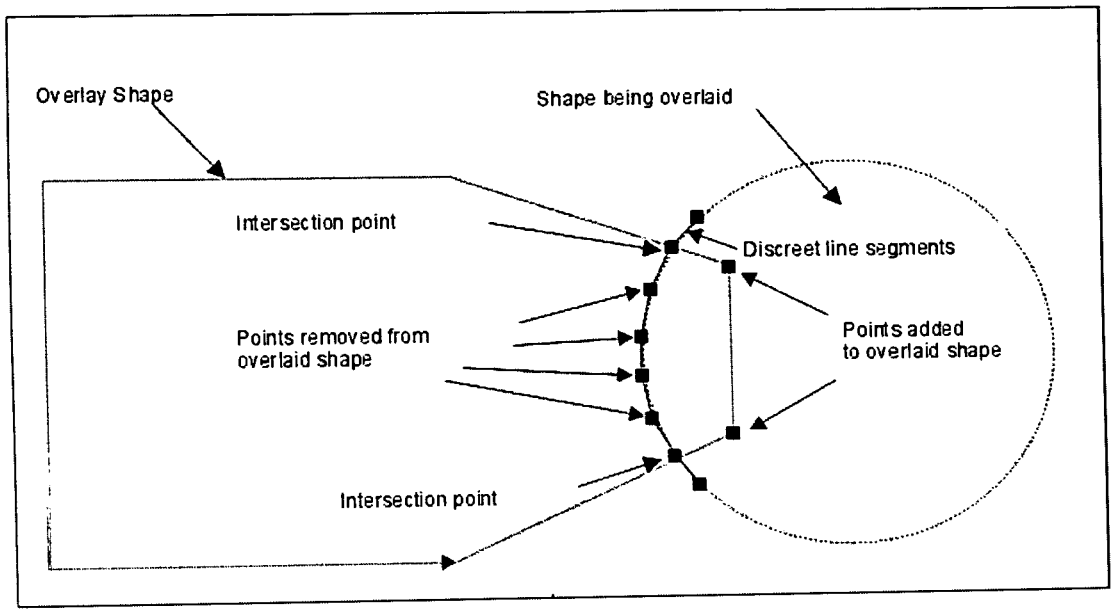
Figure 10:
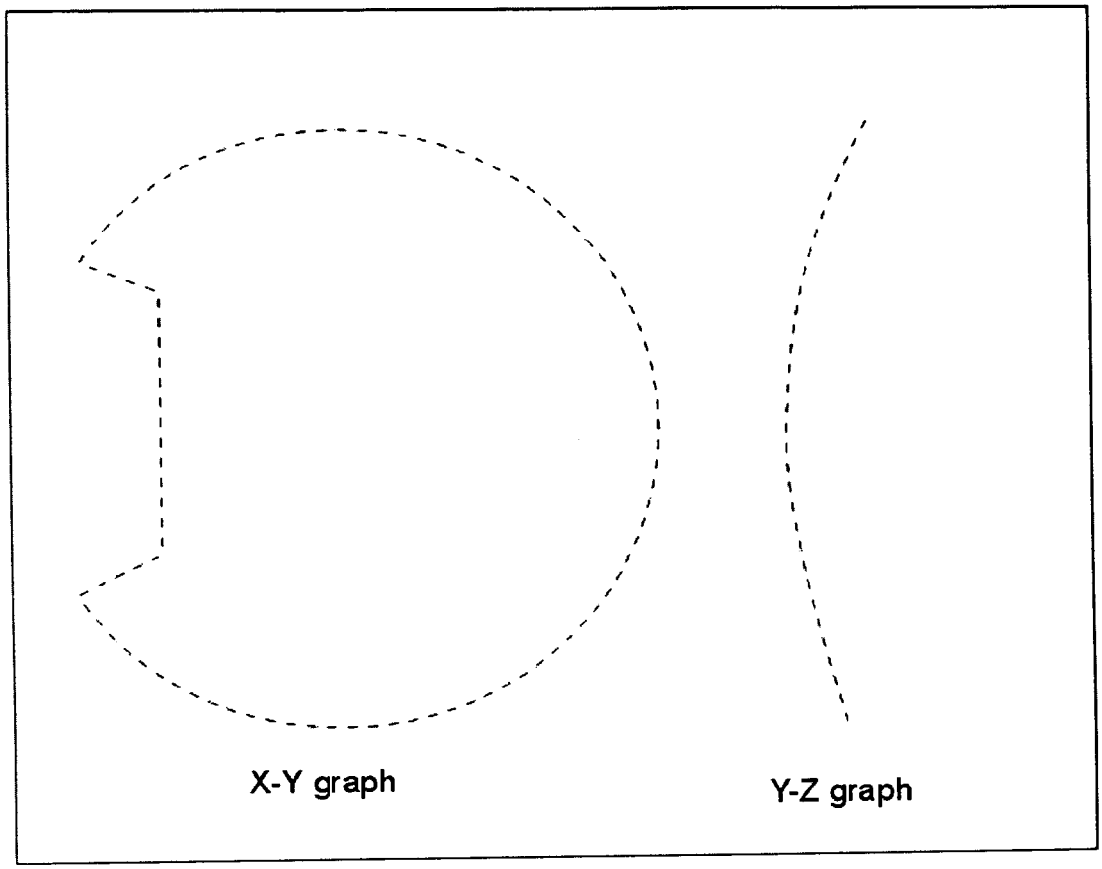
Figure 11:
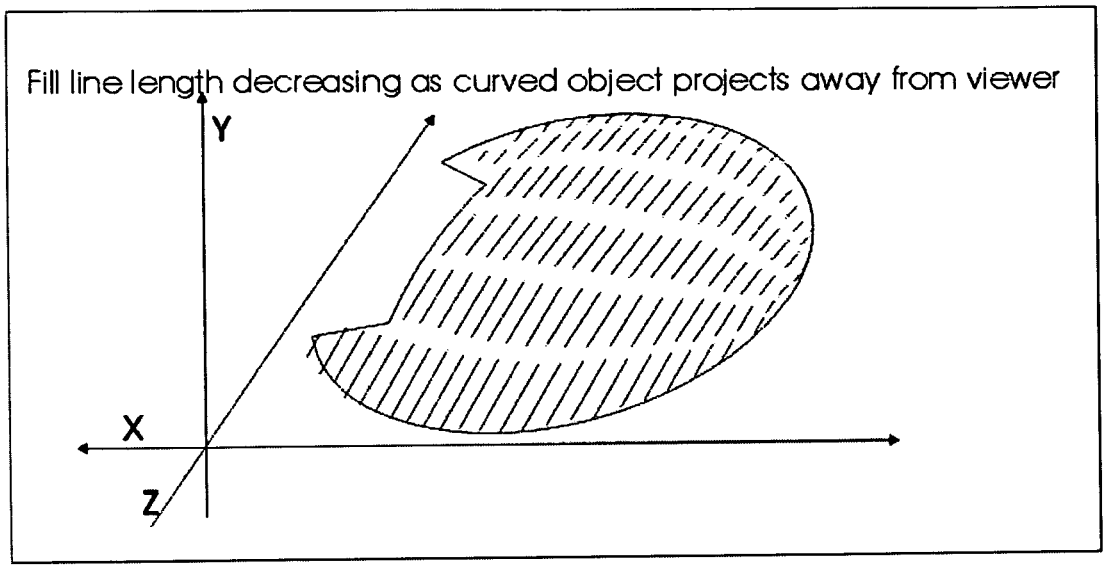
Figure 12:
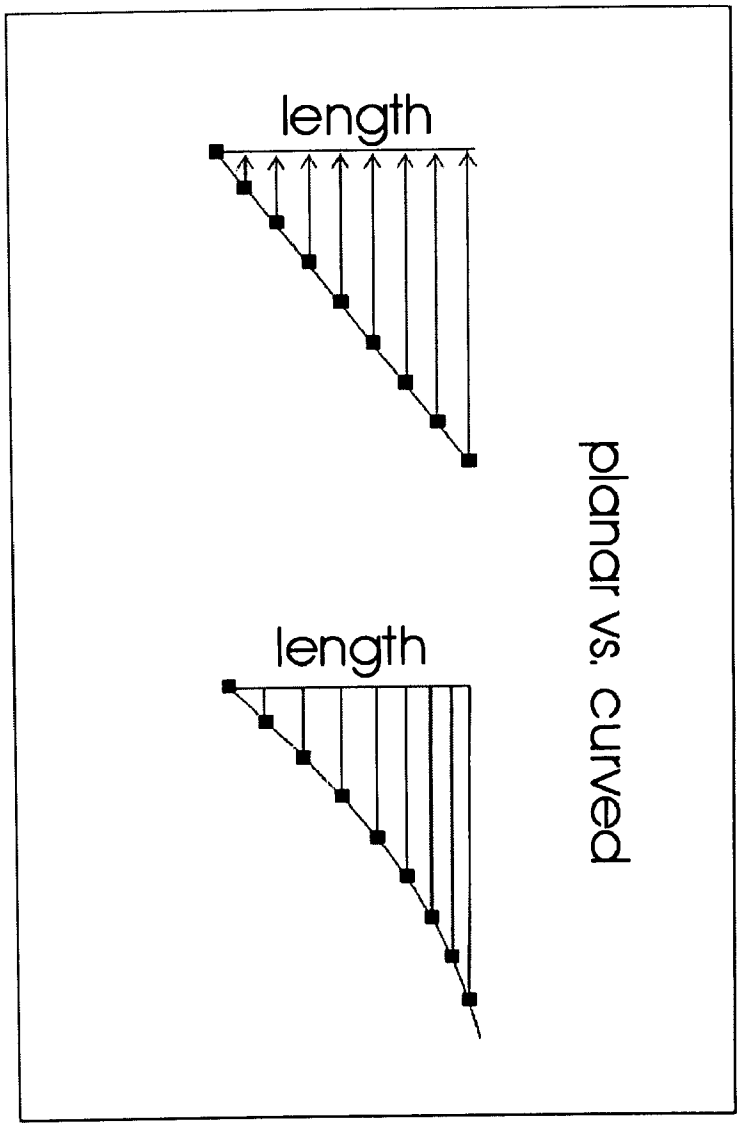

FIGS. 8-12 illustrate line drawings of a shape in various stages according to the invention. FIG. 8 illustrates an original 4-sided rectangular shape which is modified to an 8-sided shape. FIG. 9 illustrates part of the modified shape of FIG. 8 overlaid on a circular shape. FIG. 10 illustrates the result of the overlay of FIG. 9 and the resultant clipping of the circular shape. FIG. 11 illustrates how stitch lengths, which customarily would be equal on all stitches in a given region, are modified based on the curvature of the circular shape. FIG. 12 shows the apparent length of stitches from an x-axis and a z-axis curve when projected onto an x-axis and a y-axis plane, showing how the stitch lengths need to be adjusted for improved creation of the final stitch data.

Drawing 1 (FIG. 8) illustrates a simple square shape object labeled as "Original shape". The points labeled i1, j1, k1 and l1 represent variable shape data as previously defined by an artist. The points labeled i2, j2, k2 and l2 represent those same points after embroidery machine operator input UI1 has specified a change, where the points have translated along the vectors V1 and V2. Thus, if the embroidery machine operator alters the input control parameter UI1 to 0%, the shape remains in the original form. If the embroidery machine operator increases the parameter UI1, the shape changes by translating points i1, j1 to the right along vector V1 and by translating points k1 and l1 to the right along vector V2.

Drawing 2 (FIG. 9) illustrates the same simple square "Original Shape" with the points k1 and l1 translated to the right to form a modified shape. In Drawing 2, the modified shape is imposed upon or laid over another object, i.e., a circular shape, which could be the result of a rotation in three-dimensional space. This imposition would normally result in extra layers of thread being embroidered, which is both wasteful and produces an undesirable result.

According to one embodiment of the invention, a modification of the shapes can take place to solve this problem. First, the plurality of shape objects are sorted by the software in their order of z-axis distance from the viewer. Objects that are more forward are used in a shape adjusting process that modifies the shapes of objects that are further away from the viewer in z-axis order. The shape adjusting process is comprised of discovering intersections between two shapes, removing outline data from the shape being processed, said outline data is that which is determined to be within the shape that exists more forward in the z-axis order from the shape being modified, and insertion of the shape data from the forward object into the shape data of the object being modified. Objects that have minimal visible area are deleted from the design.

To discover intersections, the first step is to subdivide the objects' shape data into discrete line segments, the preferred embodiment regards any curve data in the shape as a set of discreet line segments not to exceed 1.5 millimeters in length. Where the section of shape data is itself linear, subdivision yields no advantage and is not performed. Then the intersection points of the two objects are found. This is first handled by a simple bounding box test, as would be customary in the Art, which determines if two shapes could be occupying an overlapping area. Once the decision is made to look for intersections, this is done by repeatedly comparing the objects' shape data which is now a set of line segments, solving a straightforward system of linear equations at each comparison:

$$x=(b2d1-b2D2)/(a2B2-a2b1)$$

$$y=(a2D2-a2d1)/(a2B2-a2b1)$$

Where an intersection occurs, indicative of an overlapped area, the shape of the partially hidden object must be altered. If the intersection point is tangential to the shape being evaluated, the intersection point is considered invalid. This analysis results in pairs of intersection points marking the section of the object shape data that resides in the overlap region, and that shape data can be replaced by the shape data of the superimposed object. The result of the process applied in Drawing 2 can be seen in Drawing 3 (FIG. 10).

Once all the objects' shapes have been modified, then the final stitches of the design are created, using parameter data, which in the preferred embodiment includes stitch patterns, lengths and angles. As the stitches are created, the stitch lengths, which customarily would be equal on all stitches in a given region, are modified based on the curvature of the shape. An example of this is shown in Drawing 4 (FIG. 11). Drawing 5 (FIG. 12) shows the apparent length of stitches from an x- and a z-axis curve when projected onto an x- and a y-axis plane, clearly showing how the stitch lengths need to be adjusted for improved creation of the final stitch data. In addition to modifying the lengths in the parameter data, objects which are curved in shape can have their stitch line angles modified by applying the same rotations, transformations and scale to the parameter data. By applying these transformations, a greater illusion of dimension can be achieved in the final embroidered fabric.

Once the design is set according to the operator's desires, the design is sent from the computer to the embroidery machine, where it is used to create an embroidered fabric.

The following recite various embodiments of the invention:

In one embodiment, the invention is a system (according to FIG. 1B regarding vector data) for use by an artist and for use with an original embroidery design having shape data defining shapes and parameter data defining stitches and colors within each shape, said system for creating an adjustable embroidery design from the original embroidery design. The system comprises a processor executing instructions for:

receiving instructions (from the artist) for defining vector data which is added to the shape data to define adjustable shapes of the shape data and to create an adjustable embroidery design which corresponds to the original embroidery design; and exporting the adjustable embroidery design in a form that is readable by an embroidery machine operator computer for creating an adjusted embroidery design in response to embroidery machine operator input wherein the adjusted embroidery design is exportable as stitch instructions readable by an embroidery machine for producing an embroidered product with the adjusted embroidery design.

In another embodiment, the invention is a system (according to FIG. 1B regarding 3-D data and vector data) for use by an artist for creating an adjustable embroidery design from an original embroidery design. The system comprises a processor executing instructions for:

receiving instructions (from the artist) for defining a 3-dimensional original embroidery design having shape data defining shapes and parameter data defining stitches and colors within each shape;

receiving instructions (from the artist) for defining vector data which is added to the shape data to define adjustable shapes of the shape data and to create a 3-dimensional adjustable embroidery design which corresponds to the 3-dimensional original embroidery design; and exporting the 3-dimensional adjustable embroidery design in a form that is readable by an embroidery machine operator computer for creating a 2-dimensional adjusted embroidery design in response to embroidery machine operator input wherein the 2-dimensional adjusted embroidery design is exportable as stitch instructions readable by an embroidery machine for producing an embroidered product with the 2-dimensional adjusted embroidery design.

In another embodiment, the invention is a system (according to FIG. 1C regarding vector data) for use by an embroidery machine operator and for use with an adjustable embroidery design having shape data defining shapes and parameter data defining stitches and colors within each shape and having vector data defining adjustable shapes of the shape data, said system for creating an adjusted embroidery design from the adjustable embroidery design. The system comprises a processor executing instructions for:

receiving magnitude information (from the embroidery machine operator) for defining a magnitude of the vector data for defining specific adjustments to the shape data;

applying the defined magnitude information to the vector data of the adjustable embroidery design to adjust the shapes of the adjustable embroidery design to create new shapes thereby defining the adjusted embroidery design; and exporting the adjusted embroidery design as stitch instructions in a form that is readable by an embroidery machine for producing an embroidered product with the adjusted embroidery design.

In another embodiment, the invention is a system (according to FIG. 1C regarding 3-D data and vector data) for use by an embroidery machine operator and for use with a 3-dimensional adjustable embroidery design having shape data defining shapes and parameter data defining stitches and colors within each shape and having vector data defining adjustable shapes of the shape data, said system for creating a 2-dimensional adjusted embroidery design from the 3-dimensional adjustable embroidery design. The system comprises a processor executing instructions for:

receiving magnitude information (from the embroidery machine operator) for defining a magnitude of the vector data for defining specific adjustments to the shape data;

applying the defined magnitude information to the vector data of the 3-dimensional adjustable embroidery design to adjust the shapes of the 3-dimensional adjustable embroidery design to create new shapes thereby defining the 2-dimensional adjusted embroidery design; and exporting the 2-dimensional adjusted embroidery design as stitch instructions in a form that is readable by an embroidery machine for producing an embroidered product with the adjusted embroidery design.

Having described various embodiments of the invention in detail, it will be apparent that modifications and variations are possible without departing from the scope of the various embodiments of the invention as defined in the appended claims.

The order of execution or performance of the methods illustrated and described herein is not essential, unless otherwise specified. That is, it is contemplated by the inventors that elements of the methods may be performed in any order, unless otherwise specified, and that the methods may include more or less elements than those disclosed herein. For example, it is contemplated that executing or performing a particular element before, contemporaneously with, or after another element is within the scope of the various embodiments of the invention.

When introducing elements of the various embodiments of the present invention, the articles "a", "an", "the" and "said" are intended to mean that there are one or more of the elements. The terms "comprising", "including" and "having" are intended to be inclusive and mean that there may be additional elements other than the listed elements.

In view of the above, it will be seen that the several advantageous results attained.

As various changes could be made in the above constructions, products, and methods without departing from the scope of the various embodiments of the invention, it is intended that all matter contained in the above description and shown in the accompanying drawings shall be interpreted as illustrative and not in a limiting sense.

What is claimed is:

1. A system for use with an original embroidery design having shape data defining shapes and parameter data defining stitches and colors within each shape, said system for creating an adjusted embroidery design from the original embroidery design, said system comprising:

a tangible computer readable storage media including:

receiving instructions for defining vector data which is added to the shape data to define adjustable shapes of the shape data and to create an adjustable embroidery design which corresponds to the original embroidery design; and a processor executing the receiving instructions, said processor receiving magnitude data for defining a magnitude of the vector data for defining specific adjustments to the shape data;

said processor applying the defined magnitude data to the vector data of the adjustable embroidery design to adjust the shape data of the adjustable embroidery design to create adjusted shaped data defining new shapes and thereby defining the adjusted embroidery design; and said processor exporting the adjusted shape data as stitch data in a form readable by an embroidery machine for producing an embroidered product with the adjusted embroidery design.

2. The system of claim 1 wherein said processor applying the defined magnitude data to the vector data includes said processor adjusting the parameter data of each adjusted shape.

3. The system of claim 1 wherein the vector data includes instructions to modify the shape data to implement at least one of translational, rotational and scale changes to the shape data to create the adjusted shape data.

4. The system of claim 1 wherein the magnitude data comprises modifications to coefficients to the vector data which results in adjustments to at least one of the shape data and the parameter data.

5. The system of claim 1 wherein said shape data includes a set of n-dimensional points describing the shape outline, each of said points comprising floating-point numerical data containing n-dimensional locations in space and wherein at least one of the following:

said vector data includes a plurality of translation data, said translation data including a plurality of n-dimensional offsets and their corresponding rates of change as described by a two-dimensional curve, said curve describing an amount of displacement of the set of n-dimensional points describing the shape outline;

said vector data includes a plurality of rotation data, said rotation data including a plurality of n-dimensional offsets and their corresponding rates of change as described by a two-dimensional curve, said curve describing an amount of rotational displacement of the set of n-dimensional points describing the shape outline; and said vector data includes a plurality of scalar data, said scalar data including a plurality of n-dimensional offsets and their corresponding rates of change as described by a two-dimensional curve, said curve describing an amount of scalar displacement of the set of n-dimensional points describing the shape outline.

6. The system of claim 1 wherein said parameter data includes a plurality of information regarding stitch types and directions and wherein at least one of the following:

said parameter data are modified by said processor based on adjustments to said shape data;

said parameter data includes stitch lengths modified by said processor based on adjustments to said shape data; and said parameter data including stitch direction modified by said processor based on adjustments to said shape data.

7. The system of claim 1 wherein said processor evaluates said shape data by determining the visible component of each of the plurality of shapes corresponding to said shape data, then said processor adjusts said shape data to remove portions of said shapes that are not visible such that the embroidered fabric created as a result of the design will not be overly dense.

8. The system of claim 1 wherein the vector data includes instructions to modify the parameter data to implement at least one of translational, rotational and scale changes to the shape data to create the adjusted shape data.

9. A system for creating an adjusted embroidery design from an original embroidery design, said system comprising:

a tangible computer readable storage media including:

receiving instructions for defining a 3-dimensional original embroidery design having shape data defining shapes and parameter data defining stitches and colors within each shape;

receiving instructions for defining vector data which is added to the shape data to define adjustable shapes of the shape data and to create a 3-dimensional adjustable embroidery design which corresponds to the 3-dimensional original embroidery design; and a processor executing the receiving instructions, said processor receiving magnitude data for defining a magnitude of the vector data for defining specific adjustments to the shape data;

said processor applying the defined magnitude data to the vector data of the adjustable embroidery design to adjust the shape data of the adjustable embroidery design to create adjusted shape data defining new shapes and thereby defining a 2-dimensional adjusted embroidery design; and said processor exporting the 2-dimensional adjusted shape data as stitch data in a form readable by an embroidery machine for producing an embroidered product with the 2-dimensional adjusted embroidery design.

10. The system of claim 9 wherein said processor applying the defined magnitude data to the vector data includes said processor adjusting the parameter data of each adjusted shape.

11. The system of claim 9 wherein the vector data includes instructions to modify the shape data and/cr the parameter data to implement at least one of translational, rotational and scale changes to the shape data to create the adjusted shape data.

12. The system of claim 9 wherein the magnitude data comprises modifications to coefficients to the vector data which results in adjustments to at least one of the shape data and the parameter data.

13. The system of claim 9 wherein said shape data includes a set of n-dimensional points describing the shape outline, each of said points comprising floating-point numerical data containing n-dimensional locations in space and wherein at least one of the following:

said vector data includes a plurality of translation data, said translation data including a plurality of n-dimensional offsets and their corresponding rates of change as described by a two- dimensional curve, said curve describing an amount of displacement of the set of n-dimensional points describing the shape outline;

said vector data includes a plurality of rotation data, said rotation data including a plurality of n-dimensional offsets and their corresponding rates of change as described by a two-dimensional curve, said curve describing an amount of rotational displacement of the set of n-dimensional points describing the shape outline; and said vector data includes a plurality of scalar data, said scalar data including a plurality of n-dimensional offsets and their corresponding rates of change as described by a two-dimensional curve, said curve describing an amount of scalar displacement of the set of n-dimensional points describing the shape outline.

14. The system of claim 9 wherein said parameter data includes a plurality of information regarding stitch types and directions and wherein at least one of the following:

said parameter data are modified by said processor based on adjustments to said shape data;

said parameter data includes stitch lengths modified by said processor based on adjustments to said shape data; and said parameter data including stitch direction modified by said processor based on adjustments to said shape data.

15. The system of claim 9 wherein said processor evaluates said shape data by determining the visible component of each of the plurality of shapes corresponding to said shape data, then said processor adjusts said shape data to remove portions of said shapes that are not visible such that the embroidered fabric created as a result of the design will not be overly dense.

16. The system of claim 9 wherein the vector data includes instructions to modify the parameter data to implement at least one of translational, rotational and scale changes to the shape data to create the adjusted shape data.

17. One or more tangible computer-readable storage media having computer executable components executable by a computing device, said components for creating an adjusted embroidery design from an original embroidery design, said components comprising:

instructions for receiving input for defining a 3-dimensional original embroidery design having 3-dimensional shape data defining shapes and parameter data defining stitches and colors within each shape;

instructions for receiving input for defining vector data which is added to the shape data to define adjustable shapes of the shape data and to create a 3-dimensional adjustable embroidery design which corresponds to the 3-dimensional original embroidery design;

instructions for receiving magnitude data for defining a magnitude of the vector data for defining specific adjustments to the shape data;

instructions for applying the defined magnitude data to the vector data of the adjustable embroidery design to adjust the shape data of the adjustable embroidery design to create 2-dimensional adjusted shape data defining new shapes and thereby defining a 2-dimensional adjusted embroidery design; and instructions for exporting the 2-dimensional adjusted shape data as stitch data in a form readable by an embroidery machine for producing an embroidered product with the 2-dimensional adjusted embroidery design.

18. The media of claim 17 wherein the instructions for applying the defined magnitude data to the vector data includes instructions for adjusting the parameter data of each adjusted shape.

19. The media of claim 17 including instructions to modify the shape data to implement at least one of translational, rotational and scale changes to the shape data to create the adjusted shape data.

20. The media of claim 17 wherein said parameter data includes a plurality of information regarding stitch types and directions and wherein at least one of the following:

said parameter data are modified by said processor based on adjustments to said shape data;

said parameter data includes stitch lengths modified by said processor based on adjustments to said shape data; and said parameter data including stitch direction modified by said processor based on adjustments to said shape data.

21. The media of claim 17 including instructions to modify the parameter data to implement at least one of translational, rotational and scale changes to the shape data to create the adjusted shape data.

22. One or more tangible computer-readable storage media having computer executable components executable by a computing device, said components for creating an adjusted embroidery design from an original embroidery design, said components comprising:

instructions for receiving input for defining a 3-dimensional original embroidery design having shape data defining shapes and parameter data defining stitches and colors within each shape;

instructions for receiving input for defining vector data which is added to the shape data to define adjustable shapes of the shape data and to create a 3-dimensional adjustable embroidery design which corresponds to the 3-dimensional original embroidery design;

instructions for receiving magnitude data for defining a magnitude of the vector data for defining specific adjustments to the shape data;

instructions for applying the defined magnitude data to the vector data of the adjustable embroidery design to adjust the shapes of the adjustable embroidery design to create new shapes thereby defining a 2-dimensional adjusted embroidery design; and instructions for exporting the 2-dimensional adjusted embroidery design as stitch instructions in a form readable by an embroidery machine for producing an embroidered product with the 2-dimensional adjusted embroidery design wherein said shape data includes a set of n-dimensional points describing the shape outline, each of said points comprising floating-point numerical data containing n-dimensional locations in space and wherein at least one of the following:

said vector data includes a plurality of translation data, said translation data including a plurality of n-dimensional offsets and their corresponding rates of change as described by a two-dimensional curve, said curve describing an amount of displacement of the set of n-dimensional points describing the shape outline;

said vector data includes a plurality of rotation data, said rotation data including a plurality of n-dimensional offsets and their corresponding rates of change as described by a two-dimensional curve, said curve describing an amount of rotational displacement of the set of n-dimensional points describing the shape outline; and said vector data includes a plurality of scalar data, said scalar data including a plurality of n-dimensional offsets and their corresponding rates of change as described by a two-dimensional curve, said curve describing an amount of scalar displacement of the set of n-dimensional points describing the shape outline.

23. One or more tangible computer-readable storage media having computer executable components executable by a computing device, said components for creating an adjusted embroidery design from an original embroidery design, said components comprising:

instructions for receiving input for defining a 3-dimensional original embroidery design having shape data defining shapes and parameter data defining stitches and colors within each shape;

instructions for receiving input for defining vector data which is added to the shape data to define adjustable shapes of the shape data and to create a 3-dimensional adjustable embroidery design which corresponds to the 3-dimensional original embroidery design;

instructions for receiving magnitude information for defining a magnitude of the vector data for defining specific adjustments to the shape data;

instructions for applying the defined magnitude information to the vector data of the adjustable embroidery design to adjust the shapes of the adjustable embroidery design to create new shapes thereby defining a 2-dimensional adjusted embroidery design and instructions for exporting the 2-dimensional adjusted embroidery design as stitch instructions in a form readable by an embroidery machine for producing an embroidered product with the 2-dimensional adjusted embroidery design further comprising adjusting said shape data by determining the visible component of each of the plurality of shapes corresponding to the shape data, then adjusting said shape data to remove portions of said shapes that are not visible such that the embroidered fabric created as a result of the design will not be overly dense.

* * * * *

UNITED STATES PATENT AND TRADEMARK OFFICE

CERTIFICATE OF CORRECTION

PATENT NO. : 7,457,683 B2
APPLICATION NO. : 11/350262
DATED : November 25, 2008
INVENTOR(S) : Brian D. Bailie It is certified that error appears in the above-identified patent and that said Letters Patent is hereby corrected as shown below:

Claim 11 at column 14, lines 36-37: Please delete “and/cr the parameter data”

Claim 13 at column 14, line 53: Please delete “two- dimensional” and insert --two-dimensional--

Claim 23 at column 17, line 17: Please insert --;-- between “design” and “and”

Signed and Sealed this

Sixth Day of January, 2009

JON W. DUDAS
*Director of the United States Patent and Trademark Office*